US007082765B2

(12) United States Patent
Fortuna et al.

(10) Patent No.: US 7,082,765 B2
(45) Date of Patent: Aug. 1, 2006

(54) METHODS AND APPARATUS FOR REDUCING GAS TURBINE ENGINE EMISSIONS

(75) Inventors: Douglas Marti Fortuna, Cincinnati, OH (US); Timothy James Held, Blanchester, OH (US); David Allen Kastrup, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/931,550

(22) Filed: Sep. 1, 2004

(65) Prior Publication Data

US 2006/0042253 A1 Mar. 2, 2006

(51) Int. Cl.
*F02C 1/00* (2006.01)
*F02G 3/00* (2006.01)

(52) U.S. Cl. ..... 60/740; 60/742; 60/775

(58) Field of Classification Search ..... 60/775, 60/740, 742, 747, 746
See application file for complete search history.

(56) References Cited

U.S. PATENT DOCUMENTS 4,600,151 A * 7/1986 Bradley ..... 239/400
5,259,184 A * 11/1993 Borkowicz et al. ..... 60/39.55
5,361,578 A 11/1994 Donlan
5,408,830 A * 4/1995 Lovett ..... 60/737
5,435,126 A 7/1995 Beaudoin
5,713,205 A * 2/1998 Sciocchetti et al. ..... 60/740
5,722,230 A * 3/1998 Cohen et al. ..... 60/39.37
5,729,968 A * 3/1998 Cohen et al. ..... 60/39.6
5,826,423 A * 10/1998 Lockyer et al. ..... 60/39.463
5,836,163 A * 11/1998 Lockyer et al. ..... 60/737
5,924,275 A * 7/1999 Cohen et al. ..... 60/778
6,415,594 B1 7/2002 Durbin et al.
6,434,945 B1 * 8/2002 Mandai et al. ..... 60/740
6,609,380 B1 * 8/2003 Mick et al. ..... 60/776
6,722,132 B1 * 4/2004 Stuttaford et al. ..... 60/737
6,915,636 B1 * 7/2005 Stuttaford et al. ..... 60/737
2001/0004827 A1 * 6/2001 Vandervort et al. ..... 60/39.55
2004/0006989 A1 * 1/2004 Stuttaford et al. ..... 60/776
2004/0006991 A1 * 1/2004 Stuttaford et al. ..... 60/776
2004/0035114 A1 * 2/2004 Hayashi et al. ..... 60/737

* cited by examiner

*Primary Examiner*—William H. Rodriguez
(74) *Attorney, Agent, or Firm*—William Scott Andes; Armstrong Teasdale LLP

(57) ABSTRACT

A method enables a gas turbine engine to be assembled. The method comprises coupling a fuel nozzle within the engine to inject fuel into the engine, wherein the fuel nozzle includes three independent injection circuits arranged such that the second injection circuit is between the first and third injection circuits, coupling a liquid fuel source to a first injection circuit defined within the nozzle and including an annular discharge opening, and coupling a water source to one of the second injection circuit and the third injection circuits such that the water source is coupled in flow communication to an annular discharge opening.

19 Claims, 3 Drawing Sheets

METHODS AND APPARATUS FOR REDUCING GAS TURBINE ENGINE EMISSIONS

BACKGROUND OF THE INVENTION

This invention relates generally to gas turbine engines, more particularly to combustors used with gas turbine engines.

Known turbine engines include a compressor for compressing air which is suitably mixed with a fuel and channeled to a combustor wherein the mixture is ignited within a combustion chamber for generating hot combustion gases. More specifically, at least some known combustors include a dome assembly, a cowling, and liners to channel the combustion gases to a turbine, which extracts energy from the combustion gases for powering the compressor, as well as producing useful work to propel an aircraft in flight or to power a load, such as an electrical generator. Moreover, at least some known combustors include ignition devices, such as ignitors, primer nozzles, and/or pilot fuel nozzles, which are used during pre-selected engine operations to facilitate igniting the mixture within the combustion gases.

At least some known fuel injectors are dual fuel injectors capable of supplying a liquid fuel, a gaseous fuel, or a mixture of liquid and gaseous fuels to the combustor. To facilitate reducing emissions within such combustors, at least some known combustors include water injection systems to facilitate nitrous oxide emission abatement. Within such systems, the water is premixed with the fuel during liquid fuel operation and is injected into the combustor through the fuel injector. Combining the water with liquid fuel in a single fuel circuit provides a design compromise, as the fuel/water mixture is optimized for flow and atomization, rather than requiring the liquid fuel and water to be individually optimized. However, within known fuel injectors, the water injection may provide only limited benefits, as the combined fuel/water mixture may become unmanageable at higher fuel flows.

BRIEF DESCRIPTION OF THE INVENTION

In one aspect, a method for assembling a gas turbine engine is provided. The method comprises coupling a fuel nozzle within the engine to inject fuel into the engine, wherein the fuel nozzle includes three independent injection circuits arranged such that the second injection circuit is between the first and third injection circuits, coupling a liquid fuel source to a first injection circuit defined within the nozzle and including an annular discharge opening, and coupling a water source to one of the second injection circuit and the third injection circuits such that the water is coupled in flow communication to an annular discharge opening.

In another aspect, a fuel nozzle for a gas turbine engine is provided. The fuel nozzle includes three injection circuits. A first injection circuit includes an annular discharge opening and is for injecting liquid fuel downstream from the nozzle into the gas turbine engine. The second injection circuit is aligned substantially concentrically with respect to the first injection circuit. The third injection circuit is aligned substantially concentrically with respect to the first injection circuit, such that the second injection circuit is between the first and third injection circuits. One of the second and third injection circuits is for injecting water downstream from the nozzle into the gas turbine engine. One of the second injection circuit and the third injection circuit includes an annular discharge opening.

In a further aspect a gas turbine engine includes a combustor including a combustion chamber and at least one fuel nozzle. The at least one fuel nozzle includes three injection circuits. The first injection circuit includes an annular discharge opening and is for injecting only liquid fuel into the combustion chamber. The second injection circuit is aligned substantially concentrically with respect to the first and third injection circuits, such that the second injection circuit extends between the first and third injection circuits. One of the second and third injection circuits includes an annular discharge. One of the second and third injection circuits is for only injecting water into the combustion chamber.

DETAILED DESCRIPTION OF THE INVENTION

Figure 1:
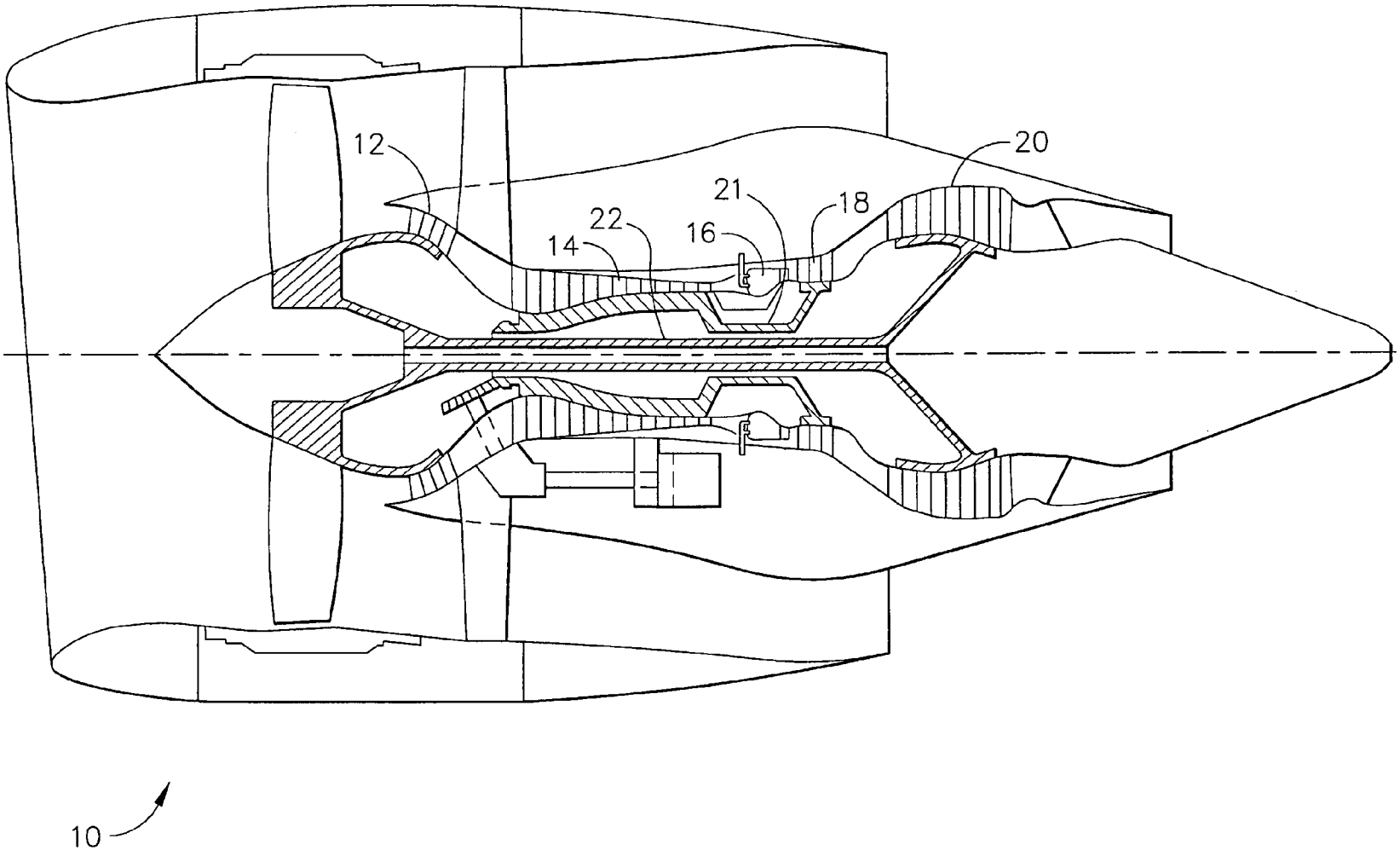
FIG. 1 is a schematic of an exemplary gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 22, and compressor 14 and turbine 18 are coupled by a second shaft 21.

In operation, air flows through low pressure compressor 12 and compressed air is supplied from low pressure compressor 12 to high pressure compressor 14. The highly compressed air is delivered to combustor 16. Airflow from combustor 16 exits combustor 16 and drives turbines 18 and 20, and then exits gas turbine engine 10.

Figure 2:
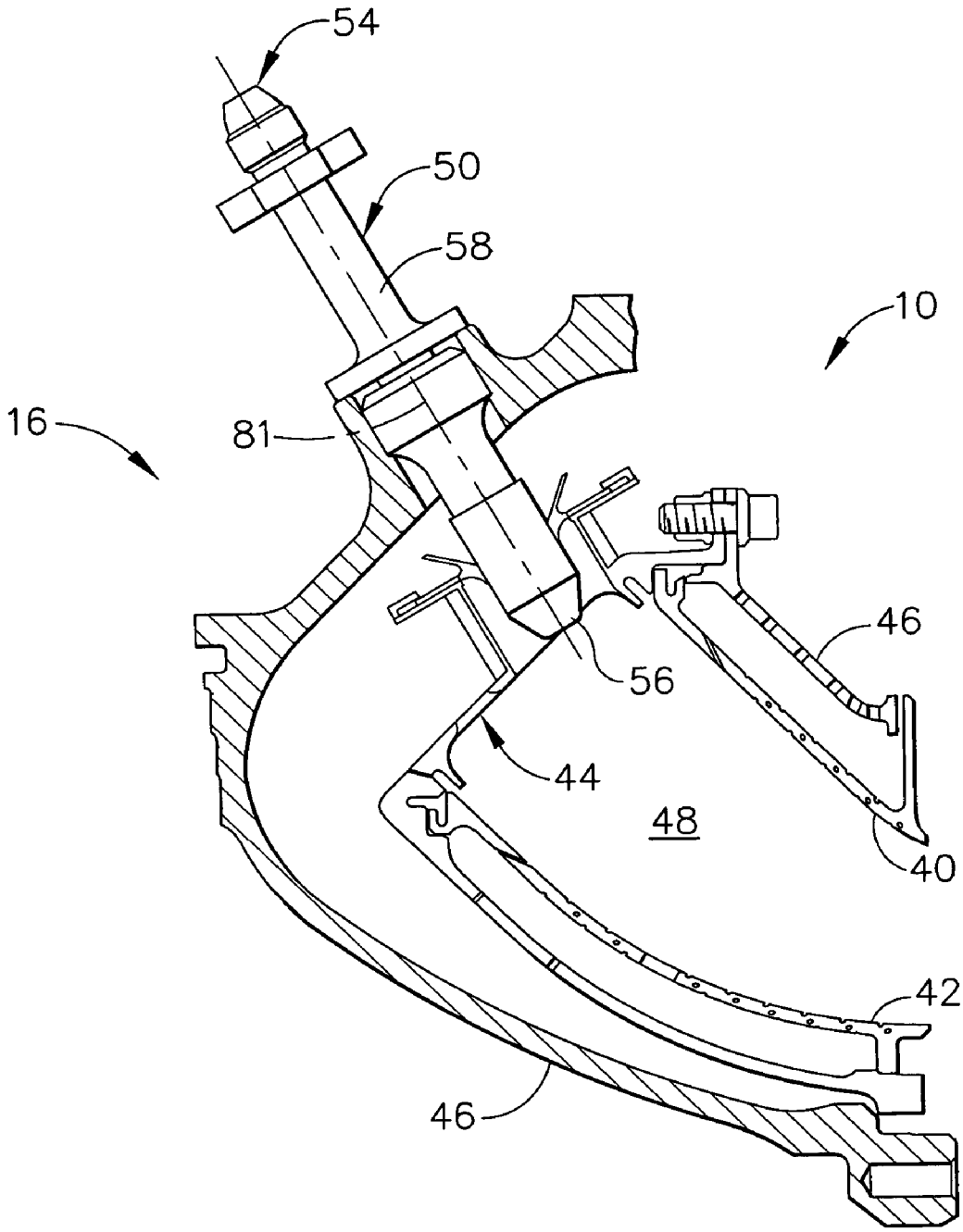
FIG. 2 is a cross-sectional illustration of an exemplary combustor that may be used with the gas turbine engine shown in FIG. 1.

FIG. 2 is a cross-sectional illustration of a portion of an exemplary combustor 16 that may be used with gas turbine engine 10. Combustor 16 includes an annular outer liner 40, an annular inner liner 42, and a domed end 44 that extends between outer and inner liners 40 and 42, respectively. Outer liner 40 and inner liner 42 are spaced radially inward from a combustor casing 46 and define a combustion chamber 48 therebetween. Combustor casing 46 is generally annular and extends around combustor 16. Combustion chamber 48 is generally annular in shape and is defined between from liners 40 and 42.

A fuel nozzle 50 extends through domed end 44 for discharging fuel into combustion chamber 48, as described in more detail below. In one embodiment, fuel nozzle 50 is aligned substantially concentrically with respect to combustor 16. In the exemplary embodiment, fuel nozzle 50 includes an inlet 54, an injection or discharge tip 56, and a body 58 extending therebetween.

Figure 4:
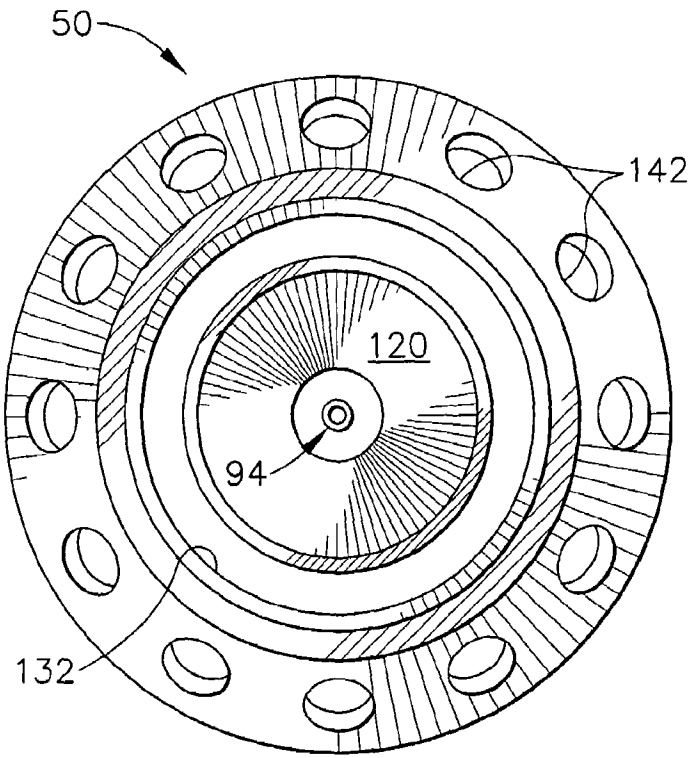
FIG. 4 is an end view of the fuel nozzle shown in FIG. 3.
Figure 3:
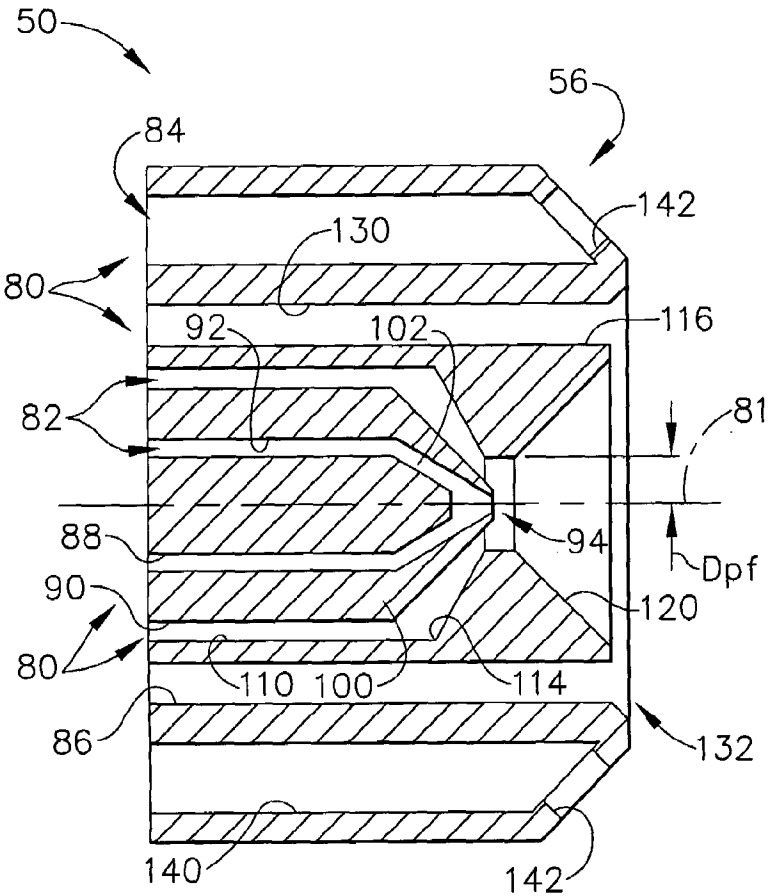
FIG. 3 is an enlarged cross-sectional view of a portion of the fuel nozzle shown in FIG. 2.

FIG. 3 is an enlarged side view of a portion of fuel nozzle 50, and FIG. 4 is an end view of fuel nozzle 50. Fuel nozzle 50 is a quad-annular fuel nozzle that includes a plurality of injection circuits 80 and a center axis of symmetry 81 extending therethrough. Specifically, injection circuits 80 are each routed independently through fuel nozzle 50 such that none of the injection circuits 80 are in flow communication with each other within nozzle 50.

Fuel nozzle 50 includes a liquid fuel injection circuit 82, a gaseous fuel injection circuit 84, and a water injection circuit 86. Liquid fuel injection circuit 82 includes a primary fuel injection circuit 88 and a secondary fuel injection circuit 90 that are each coupled in flow communication to a liquid fuel source for injecting only liquid fuel downstream therefrom into combustion chamber 48. Primary fuel injection circuit 88 includes an annular fuel passageway 92 that extends substantially concentrically through nozzle 50 to an annular discharge opening 94. In the exemplary embodiment, fuel passageway 92 and discharge opening 94 are each toroidal.

In the exemplary embodiment, fuel passageway 92 extends substantially co-axially through nozzle 50 with respect to axis of symmetry 81 such that passageway 92 is a radial distance $D_{pf}$ from axis of symmetry 81 such that fuel flowing therein flows substantially parallel to axis of symmetry 81 until flowing through an elbow 100. Elbow 100 is positioned upstream from, and in close proximity to, discharge opening 94 and directs liquid fuel into a convergent portion 102 of passageway 92 such that liquid fuel is discharged inwardly from passageway 92 towards axis of symmetry 81.

Secondary fuel injection circuit 90 includes an annular fuel passageway 110 that extends substantially concentrically through nozzle 50 to annular discharge opening 94. In the exemplary embodiment, fuel passageway 110 is toroidal and is radially outward from fuel passageway 92. More specifically, in the exemplary embodiment, fuel passageway 110 is substantially concentrically aligned with respect to fuel passageway 92, and with respect to axis of symmetry 81. Accordingly, liquid fuel flowing within passageway 110 flows substantially parallel to axis of symmetry 81 until flowing through an elbow 114. Elbow 114 is positioned upstream from, and in close proximity to, discharge opening 94 and directs liquid fuel into a convergent portion 116 of passageway 110 such that liquid fuel is discharged inwardly from passageway 110 towards axis of symmetry 81.

Nozzle discharge tip 56 includes a nozzle portion 120 that extends divergently downstream from, and in flow communication with, opening 94. Accordingly, the combination of passageway convergent portions 102 and 116, opening 94, and divergent nozzle portion 120 creates a venturi that facilitates enhancing control of flow discharged from nozzle discharge tip 56. More specifically, the relative location of opening 94 within discharge tip 56 and with respect to nozzle portion 120 facilitates reducing dwell time for fuel within nozzle discharge tip 56, such that coking potential within nozzle discharge tip 56 is also facilitated to be reduced.

Water injection circuit 86 is used to supply only water to combustion chamber 48 and includes an annular water injection passageway 130 that extends substantially concentrically through nozzle 50 to an annular discharge opening 132. In the exemplary embodiment, fuel passageway 130 is toroidal and is positioned radially outward from fuel passageway 110. More specifically, in the exemplary embodiment, water injection passageway 130 is coupled to a water source and is substantially concentrically aligned with respect to fuel passageways 92 and 110, and with respect to axis of symmetry 81. Accordingly, water flowing within passageway 130 flows substantially parallel to axis of symmetry 81 until being discharged through annular discharge opening 132. In the exemplary embodiment, opening 132 is a distance downstream from opening 94. Accordingly, the orientation of discharge opening 132 with respect to opening 94, ensures that water is discharged from opening 132 at a wider spray angle than that of the liquid fuel discharged from opening 94, thus facilitating nitrous oxide abatement. Moreover, the narrower spray angle of the liquid fuel facilitates positioning the liquid fuel towards an aft end of the venturi, thus reducing dwell time and coking potential.

Gaseous fuel injection circuit 84 is coupled to a gaseous fuel circuit such that only gaseous fuel is supplied to combustion chamber 48 during pre-determined engine operating conditions by circuit 84. Gaseous fuel injection circuit 84 includes an annular fuel passageway 140 that extends substantially concentrically through nozzle 50 to a plurality of circumferentially-spaced discharge openings 142. In the exemplary embodiment, fuel passageway 140 is toroidal and is positioned radially outward from water injection passageway 130. In an alternative embodiment, water injection passageway 130 is positioned radially between primary fuel injection circuit fuel passageway 92 and gaseous fuel injection fuel passageway 140. Within such an embodiment, secondary fuel injection circuit fuel passageway 110 is positioned radially outward from gaseous fuel injection passageway 140. More specifically, in the exemplary embodiment, gaseous fuel injection passageway 140 is substantially concentrically aligned with respect to fuel passageways 92 and 110, and with respect to axis of symmetry 81. Accordingly, gaseous fuel flowing within passageway 140 flows substantially parallel to axis of symmetry 81 until being discharged through discharge openings 142.

In the exemplary embodiment, gaseous fuel injection openings 142 are oriented obliquely with respect to axis of symmetry 81. Accordingly, gaseous fuel discharged from openings 142 is expelled outwardly away from axis of symmetry 81.

During initial engine operation, and through engine idle operation, only primary fuel injection circuit 88 is used to supply fuel to combustion chamber 48. More specifically, primary fuel injection circuit 88 provides atomization of low fuel flows required for engine starting and transition to engine idle operation.

During higher power operations, the remaining liquid fuel required for operation is injected through secondary fuel injection circuit 90, and gaseous fuel may be injected through gaseous fuel injection circuit 84. In one embodiment, secondary fuel injection circuit 90 provides up to approximately 95% of total liquid fuel flow required for high power engine operations. During such operations, water is introduced to combustion chamber 48 through water injection circuit 86. Water injection facilitates abating nitrous oxide generation within combustion chamber 48. Moreover, in the exemplary embodiment, atomization is facilitated through a liquid water sheet formation induced by swirling the water flow within water injection circuit 86. In an alternative embodiment, bleed air from a compressor discharge is used to facilitate atomization of the water flow. In a further alternative embodiment, natural gas flow is used to facilitate atomization of the water flow.

Because fuel is injected through independent injection circuits, the plurality of independent injection circuits 80 facilitates the independent optimization of each circuit for each mode of operation, including a liquid fuel dry mode, in which no water is injected into chamber 48, a liquid fuel+$NO_x$ water abatement mode of operation, and a gaseous fuel+$NO_x$ water abatement mode of operation. Accordingly, optimization of the circuits 80 is facilitated at all engine operational power settings.

The above-described fuel nozzle provides a cost-effective and reliable means for reducing nitrous oxide emissions generated within a combustor. The fuel nozzle includes a plurality of independent injection circuits that facilitate enhanced optimization of fluids to be injected into the combustion chamber. More specifically, because water and fuel are not mixed within, or upstream from the fuel nozzle, the flows of each may be independently optimized. As a result, injection schemes are provided which facilitate reducing nitrous oxide emissions at substantially all engine operating conditions.

An exemplary embodiment of a fuel nozzle is described above in detail. The fuel nozzle components illustrated are not limited to the specific embodiments described herein, but rather, components of each fuel nozzle may be utilized independently and separately from other components described herein. For example, the plurality of injection circuits may be used with other fuel nozzles or in combination with other engine combustion systems.

While the invention has been described in terms of various specific embodiments, those skilled in the art will recognize that the invention can be practiced with modification within the spirit and scope of the claims.

What is claimed is:

1. A method for assembling a gas turbine engine, said method comprising:

coupling a fuel nozzle within the engine to inject fuel into the engine, wherein the fuel nozzle includes three independent injection circuits arranged such that the second injection circuit is between the first and third injection circuits;

coupling a liquid fuel source to a first injection circuit defined within the nozzle and including a first annular discharge opening; and coupling a water source to one of the second injection circuit and the third injection circuits such that the water is coupled in flow communication to a second annular discharge opening, such that the water is discharged from the second annular discharge opening at a wider spray angle than that of the liquid fuel discharged from the first annular discharge opening.

2. A method in accordance with claim 1 wherein coupling a liquid fuel source to a first injection circuit further comprises coupling a liquid fuel source to a primary injection circuit and to a secondary injection circuit.

3. A method in accordance with claim 1 further comprising coupling one of the second injection circuit and the third injection circuit to a gaseous fuel source.

4. A method in accordance with claim 1 further comprising coupling one of the second injection circuit and the third injection circuit in flow communication to a gaseous fuel source such that the gaseous fuel is coupled in flow communication to a plurality of circumferentially-spaced discharge openings.

5. A method in accordance with claim 4 wherein coupling one of the second injection circuit and the third injection circuit in flow communication to a gaseous fuel source further comprises orienting the nozzle such that the first and second injection circuits discharge flow therefrom in a direction that is substantially parallel to an axis of symmetry extending through the nozzle, and such that the third injection circuit discharges flow therefrom in an oblique direction with respect to the axis of symmetry.

6. A fuel nozzle for a gas turbine engine, said fuel nozzle comprising:

a first injection circuit comprising an annular discharge opening, said first injection circuit for injecting liquid fuel downstream from said nozzle into the gas turbine engine;

a second injection circuit aligned substantially concentrically with respect to said first injection circuit;

a third injection circuit aligned substantially concentrically with respect to said first injection circuit, said first injection circuit is between said second and third injection circuits, one of said second and third injection circuits for injecting water downstream from said nozzle into the gas turbine engine, one of said second injection circuit and said third injection circuit comprising an annular discharge opening; and a centerline axis of symmetry, said third injection circuit comprises a plurality of circumferentially-spaced discharge openings configured to discharge fluids obliquely outward from said nozzle with respect to said centerline axis of symmetry.

7. A fuel nozzle in accordance with claim 6 wherein said first injection circuit comprises a primary fuel circuit and a secondary fuel circuit, said primary fuel circuit radially inward from said secondary fuel circuit.

8. A fuel nozzle in accordance with claim 7 wherein only said primary fuel circuit is configured to inject fuel into the gas turbine engine during engine start-up and idle operating conditions.

9. A fuel nozzle in accordance with claim 6 further comprising a centerline axis of symmetry, said first injection circuit is a radial distance from said centerline axis of symmetry.

10. A fuel nozzle in accordance with claim 6 wherein one of said second injection circuit and said third injection circuit comprises a plurality of circumferentially-spaced discharge openings.

11. A fuel nozzle in accordance with claim 6 wherein one of said second injection circuit and said third injection circuit is configured to only inject gaseous fuel downstream from said nozzle into the gas turbine engine.

12. A gas turbine engine comprising a combustor comprising a combustion chamber and at least one fuel nozzle, said at least one fuel nozzle comprising a first injection circuit, a second injection circuit, and a third injection circuit, and a nozzle discharge tip, said first injection circuit comprising a first annular discharge opening, said first injection circuit for injecting only liquid fuel into said combustion chamber, said second injection circuit is aligned substantially concentrically with respect to said first and third injection circuits, such that said second injection circuit extends between said first and third injection circuits, one of said second and third injection circuits comprises a second annular discharge opening, one of said second and third injection circuits is for only injecting water into said combustion chamber, wherein the water exits said second annular discharge opening at said nozzle discharge tip, and the liquid fuel exits said first annular discharge opening upstream from said nozzle discharge tip.

13. A gas turbine engine in accordance with claim 12 wherein said first injection circuit comprises a primary fuel circuit and a secondary fuel circuit, said primary fuel circuit radially inward from said secondary fuel circuit.

14. A gas turbine engine in accordance with claim 13 wherein said primary fuel circuit is configured to inject liquid fuel into said combustion chamber only during engine-start up and idle operating conditions.

15. A gas turbine engine in accordance with claim 13 wherein one of said second injection circuit and said third injection circuit is configured to only inject gaseous fuel into said combustion chamber.

16. A gas turbine engine in accordance with claim 13 wherein said nozzle comprises an axis of symmetry extending therethrough, said first injection circuit is oriented to discharge liquid fuel from said nozzle in a direction that is substantially parallel to said axis of symmetry.

17. A gas turbine engine in accordance with claim 13 wherein said nozzle comprises an axis of symmetry extending therethrough, said second injection circuit is oriented to discharge water from said nozzle in a direction that is substantially parallel to said axis of symmetry, said third injection circuit is oriented to discharge gaseous fuel from said nozzle in an oblique direction with respect to said axis of symmetry.

18. A gas turbine engine in accordance with claim 13 wherein said nozzle comprises an axis of symmetry extending therethrough, said third injection circuit comprises a plurality of circumferentially-spaced openings configured to discharge gaseous fuel from said nozzle in an oblique direction with respect to said axis of symmetry.

19. A gas turbine engine in accordance with claim 13 wherein said nozzle comprises an axis of symmetry extending therethrough, said first injection circuit is a radial distance from said centerline axis of symmetry.

* * * * *